United States Patent [19]

McLeod

[11] Patent Number: 4,850,164

[45] Date of Patent: Jul. 25, 1989

[54] MULTI-UNIT STAIR CONSTRUCTION AND METHOD

[76] Inventor: Duncan T. McLeod, P.O. Box 770795, Eagle River, Ak. 99577

[21] Appl. No.: 180,567

[22] Filed: Apr. 12, 1988

[51] Int. Cl.[4] ..... E04F 11/00

[52] U.S. Cl. ..... 52/182; 52/187

[58] Field of Search ..... 52/187, 182

[56] References Cited

U.S. PATENT DOCUMENTS

| | | | |
|---|---|---|---|
| 1,547,254 | 7/1925 | McClure | 52/187 |
| 1,716,713 | 6/1929 | Rossum | 52/187 |
| 3,430,729 | 3/1969 | Miceli | 52/187 |
| 3,473,275 | 10/1969 | Lappin | 52/187 |
| 3,513,547 | 5/1970 | Suckno | 52/187 |
| 4,722,374 | 2/1988 | Bond | 52/187 X |

FOREIGN PATENT DOCUMENTS

| | | | |
|---|---|---|---|
| 10482 | 6/1956 | Fed. Rep. of Germany | 52/187 |
| 2516136 | 5/1983 | France | 52/182 |

*Primary Examiner*—David A. Scherbel
*Assistant Examiner*—Jerrold D. Johnson
*Attorney, Agent, or Firm*—Kimmel, Crowell & Weaver

[57] ABSTRACT

The present invention comprises a stair construction and method in which the stair includes at least one stringer assembled in situ from a plurality of stringer units, treads supported on the stringer, and a hand rail comprised of a plurality of hand rail units or sections secured together in situ. The use of modular construction, with the parts assembled in situ on a job site, enables the components to be manufactured in a factory and then shipped in convenient packages to the job site for assembly. This enables relatively complex stair designs, such as spiral and circular stairs, as well as more conventional straight stairs to be employed in construction without concern for bulky and difficult to handle packaging and shipping, or the need for skilled carpenters using special tools to construct such stairs on the job site. Moreover, the basic nature of the invention makes it possible to mass produce all the components to exacting standards, thereby eliminating the need to preassemble the stair prior to shipping, as required with prior art systems.

12 Claims, 5 Drawing Sheets

MULTI-UNIT STAIR CONSTRUCTION AND METHOD

FIELD OF THE INVENTION

This invention relates to stair systems, and more particularly, to an improved spiral or straight stair and method of construction.

PRIOR ART

Various stair designs are known in the prior art for gaining access between floors of residential and commercial buildings. Most such stair constructions employ one-piece, continuous stringers and hand rails. While this does not ordinarily present any problem, the use of one-piece, continuous stringers and hand rails either requires that killed carpenters using special tools construct the stairs in situ, or that special and expensive packaging, shipping and handling requirements be met in order to ship pre-constructed stairs or stair components from a manufacturing facility to the job site.

These conditions are particularly true for spiral or circular stair designs, which are gaining in popularity because of the relatively smaller amount of floor space they occupy as compared with straight stair designs. In other words, while a spiral stairway occupies a relatively small space when installed in a building, it is relatively difficult to construct. On the other hand, pre-manufactured spiral stairs present special packaging and shipping difficulties. Moreover, even after such stairs reach a job site, difficulty may be encountered in getting the stairway into the building in which it is to be used. Further, many spiral and circular stairways are made of metal. Such metal stairways require even higher levels of skill and more specialized tools to construct.

At least partially because of the above-noted difficulties, efforts have been made in the prior art to provide stair designs which either can be assembled on the job site from pre-manufactured components, or which are so constructed that they require smaller packaging than previous spiral stair designs.

Examples of some prior art designs are shown in U.S. Pat. Nos. 3,473,275, 3,513,547, 4,655,017 and 4,660,335. In U.S. Pat. No. 3,473,275, for example, a spiral stair design is described in which the stringers (columns) 16 and 18 are made of pre-manufactured individual modules or tread supporting units which are assembled to form a completed stairway. The tread supporting units have mating recesses and protrusions to lend strength to the assembled stair, and are preferably made of metal. From the disclosure in this patent, it appears that the object of the invention is to provide a stair design which has superior strength, rather than to provide a design which is simple in construction and which may be shipped disassembled to a job site and then put together by persons who do not possess any special skills and who do not need special tools. There is no mention in the patent of in situ assembly of the stairway. Moreover, this patent discloses a so-called flying spiral stairway in which there is neither a center support column nor a hand rail. Further, the stair components of this structure are described as comprising metal or fiberglass or equivalent material. This type of construction requires manufacturing to very specific dimensions and has no means of adjustment once manufactured.

U.S. Pat. No. 3,513,547 discloses a circular staircase in which a plurality of treads 20 are supported from a center column 12 by radially extending braces 30. A hand rail 43 connects the treads via balusters 40 for further reinforcement of the stairs. Fascias 44 extend beneath the treads and are connected with the balusters for adding further strength to the stairway. There is no suggestion in this patent of the pre-manufactured modular or unit design of stringers and/o hand rails which permit the stair to be manufactured at a factory and then shipped in manageable packages to a job site for in situ assembly into a completed stair.

U.S. Pat. No. 4,655,017 describes a spiral or circular stairway design in which a plurality of treads 15 are attached to a center support column 11 at a factory and shipped to a job site for assembly with a separately manufactured hand rail 18. This patent also fails to disclose the unit or modular stringer and hand rail design of the present invention.

U.S. Pat. No. 4,660,335 describes a spiral stair design in which a plurality of treads 34 have collars 35 at their inner ends which receive a central post 10. The central post comprises a plurality of individual sections which are assembled with the treads and then secured together into a continuous column by a bolt passing longitudinally through the sections. Although this patent does disclose that the individual components can be manufactured at a factory and shipped disassembled or partially assembled to a job site for final assembly into a completed stairway, it fails to suggest the particular stair design of the invention, including the modular stringer, hand rail and center support column.

SUMMARY OF THE INVENTION

Accordingly, it an object of the present invention to provide a stair design having a modular stringer and hand rail construction, in which the stringer and hand rail are produced as a plurality of separate pieces at a factory and then shipped to a job site in a plurality of separate pieces or components which may be easily packaged and shipped, and then easily assembled in situ by persons not required to use special skills or tools to form the completed stairway.

Another object of the invention is to provide a spiral or circular stairway having a central support column, in which the column is made of a plurality of separate riser sleeves or blocks to which the treads are attached and which are telescoped over a continuous inner stem.

A further object of the invention is to provide a stair design having at least one stringer made up of a plurality of individual tread supporting units or components which are assembled together to form a continuous stringer, and in which the individual units may be adjusted in size to adjust the overall size of the completed stairway.

Yet another object of the invention is to provide a spiral or circular stairway in which a support ring is attached to the upper level of two levels joined by the stairway, and a plurality of balusters are joined to the ring and to the stringer of the stair, thereby supporting the stringer from the ring and forming a "caged" configuration.

A still further object of the invention is to provide a spiral or circular stairway design in which a plurality of treads are joined to a central column or stem by fasteners passing completely through the stem and into the adjacent end of the treads.

Another object is to provide a hanger arrangement for attaching the treads of a spiral stairway to a central support column, in which a tread hanger is attached to the column with a fastener and the adjacent end of the tread is secured to the hanger.

An even further object of the invention is to provide a spiral stair construction in which the inner ends of the treads are secured to the central support column by a fastener passed through the column and into the adjacent end of the tread, and spacer blocks are engaged between adjacent treads to space them along the column.

Another object of the invention is to provide a spiral stair design in which a center support column and outer stringer on which the treads are supported are made of individual units or components which may be secured together in situ to form a completed stairway.

A still further object of the invention is to provide a stair design in which the hand rail is made in separate units or modules which may be assembled in situ to form a completed, continuous hand rail.

An even further object is to provide a stair design in which the treads are supported at their opposite ends, leaving an opening between the treads, and in which a tread support member is engaged between adjacent treads intermediate their ends to prevent sagging thereof, while at the same time leaving an open space between the adjacent treads.

BRIEF DESCRIPTION OF THE DRAWINGS

These and other objects and advantages of the invention will become apparent from the following detailed description and claims taken in conjunction with the accompanying drawings, in which like reference characters designate like parts throughout the several views, and in which:

DETAILED DESCRIPTION OF THE PREFERRED EMBODIMENTS

Figure 2:
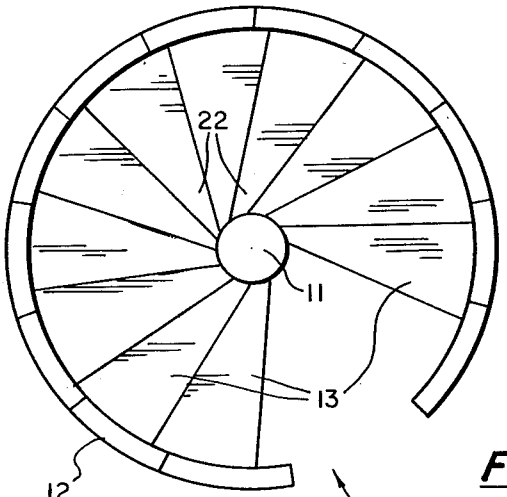
FIG. 2 is a somewhat schematic top plan view of the stairway of FIG. 1.

With reference to FIGS. 1 through 6, a first form of stairway according to the invention is indicated generally at 10 and comprises a center support column 11, outer spiral shaped stringer 12, treads 13, balusters 14, and hand rail 15.

In this form of the invention, the center support column 11 is of one-piece, continuous construction and is preferably made of wood, although other materials may be used if desired.

The treads 13 are generally pie-shaped, having tapered front and rear edges 20 and 21 converging toward a narrow inner end 22, and defining a wider outer end 23. The inner end 22 has a concave curvature 24 to match the curvature of the support column 11, and the outer end 23 has a convex curvature to match the curvature of the stringer 12. A tenon 25 is formed on the outer end of each tread for a purpose to be described hereinafter.

Figure 1:
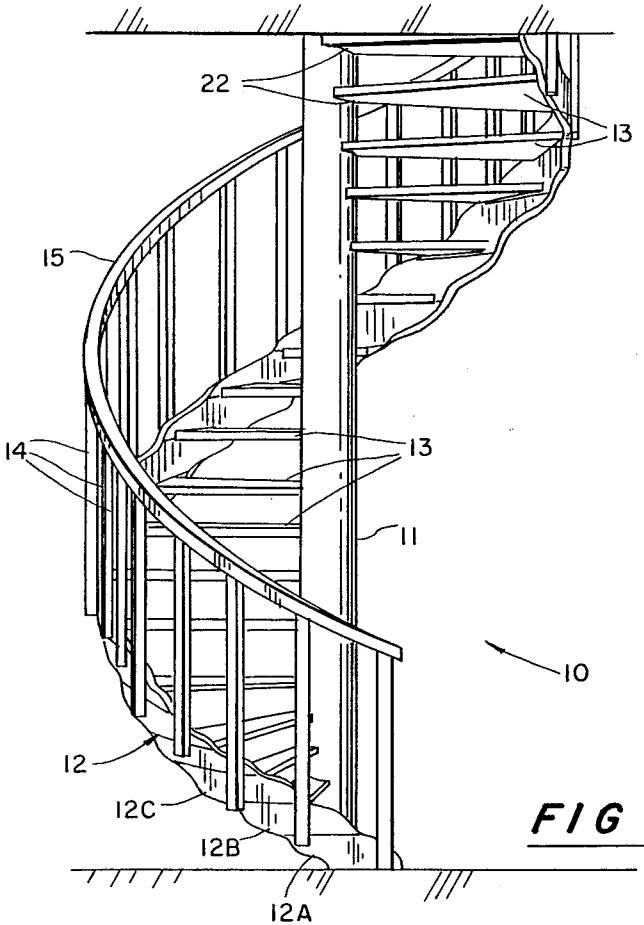
FIG. 1 is a side view in elevation of a first form of spiral or circular stairway constructed in accordance with the invention.

The stringer 12 is made up of a plurality of premanufactured individual units 12A, 12B, 12C, etc., made at a factory and shipped in suitable packaging to the job site where they are secured together to form the continuous stringer shown in FIG. 1.

Figures 3, 4, 5:
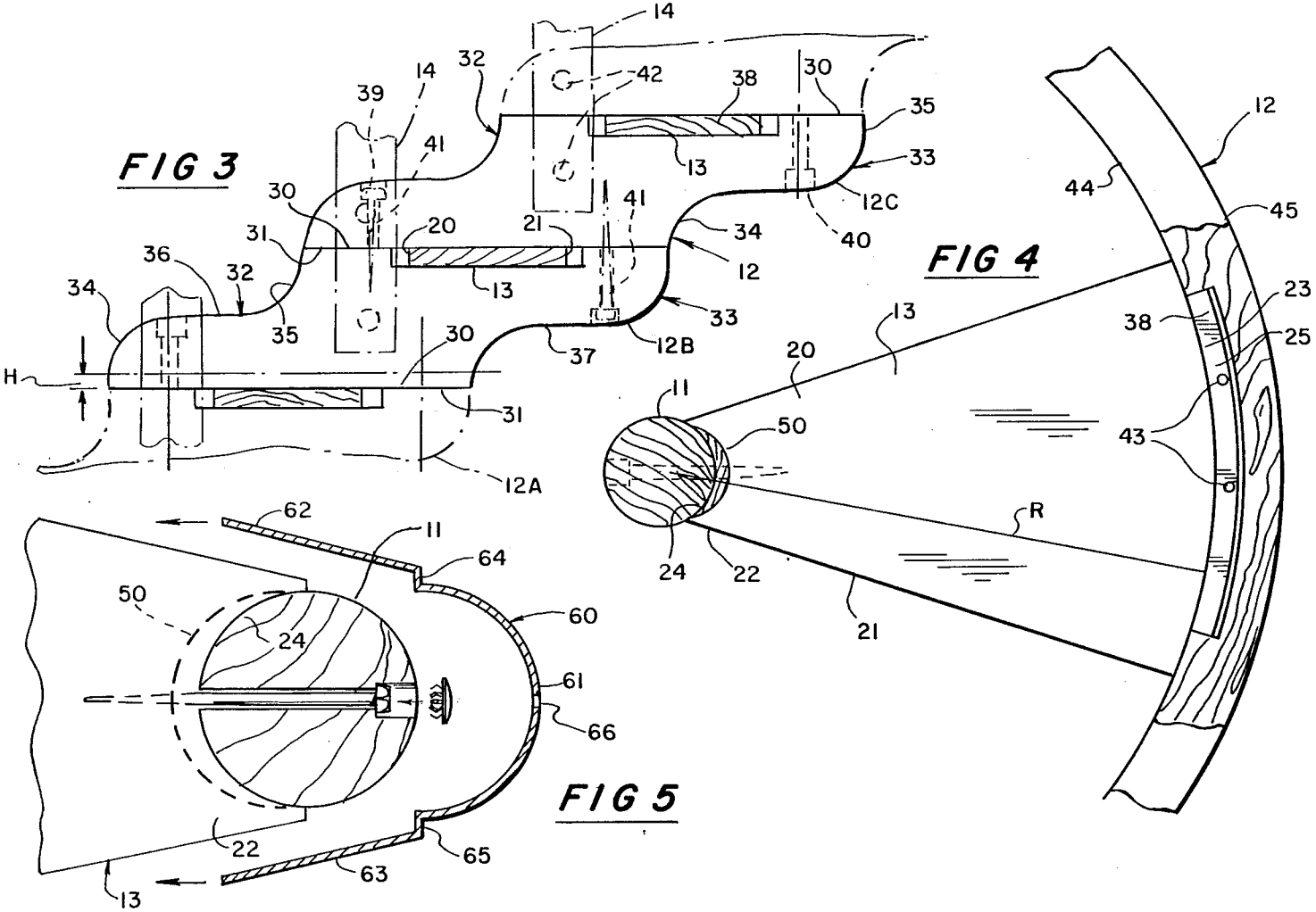
FIG. 3 is a greatly enlarged view in side elevation, with parts shown in section, of a portion of the stringer arrangement of the stairs of the invention.
FIG. 4 is a greatly enlarged fragmentary plan view, shown partly in section, of a portion of a spiral stair in accordance with the invention, showing how the inner and outer ends of the treads are connected to the center support column and outer stringer, respectively.
FIG. 5 is a further enlarged, fragmentary sectional view taken along line 5—5 in FIG. 6, showing one arrangement for attaching the inner ends of the treads to the center support column, wherein spacers are used between adjacent treads, and showing in exploded relationship an assembly tool which may be used in assembling the treads to the support column.

As shown best in FIGS. 3 and 4, the stringer units 12A, 12B, etc., have substantially straight horizontal top and bottom end surfaces 30 and 31 and curved front and rear edge surfaces 32 and 33. The curvature of the front and rear edge surfaces 32 and 33 is such that substantially vertically extending portions 34 and 35 are formed adjacent the horizontal top and bottom ends 30 and 31, the vertically extending portions being joined by generally horizontally extending portions 36 and 37.

In addition, the top end surface 30 of each stringer unit is notched or mortised at 38 for receiving the tenon 25 on the tread, and pre-drilled, countersunk openings 39 and 40 are formed through the horizontally extending portions 36 and 37 of the front and rear edge surfaces, respectively, for receiving suitable fasteners such as lag screws 41 or the like to secure the stringer units together as shown in FIGS. 1 and 3. The mortise and tenon are narrower than the tread, so that expansion and contraction between the stringer and tread can be accommodated without exposing a crack or opening between the stringer and tread. Further, as seen best in FIG. 3, when the balusters 14 are secured to the stringer, screws or other suitable fasteners 42 are extended through the balusters and into the stringer in spanning relationship to the horizontal joint between adjoining stringer units 12A, 12B, etc. During assembly of the stringer, glue is placed on the abutting surfaces of adjoining stringer units before they are assembled together, and the tenon 25 of the associated tread is secured in the mortise by use of suitable fasteners such as screws or the like 43, as well as by use of glue on the abutting surfaces of the mortise and tenon joint. Attachment of the balusters as described above further strengthens the joint between adjacent stringer sections or units.

As seen in FIGS. 1 and 4, the stringer units are formed with a radius of curvature "R" sized to form a continuous stringer 12 for a stairway 10 of predetermined dimensions. Thus, each stringer unit has a concave curved inside surface 44 and a convex curved outside surface 45.

As indicated by the arrow "H" in FIG. 3, the bottom edge 31 of the stringer units 12A, 12B, etc. may be trimmed to adjust the overall height of the stair, or to make other adjustments, as desired.

The center support column 11 is pre-drilled with a plurality of openings 46 arranged on a spiral, and countersunk at the outer end 47 for receiving suitable fasteners 48 therethrough to secure the inner ends of the treads to the column 11.

Figure 6:
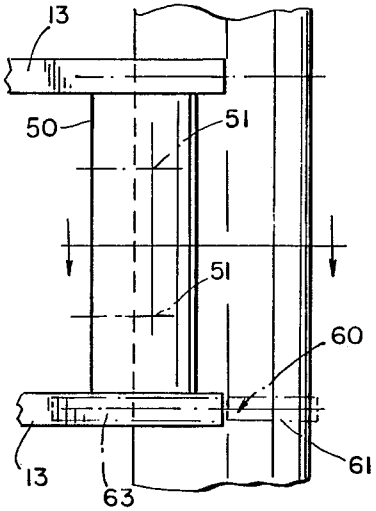
FIG. 6 is an enlarged, fragmentary view in elevation of a portion of the center support column of a spiral stairway constructed in accordance with the form of the invention shown in FIG. 5, also showing the assembly tool in dot-and-dash lines associated with the bottom tread.

A first method of securing the treads to the column is shown in FIGS. 4, 5 and 6. In this form of the invention, spacers 50 are positioned between adjacent treads and secured to the column 11 by fasteners 51 extended through the spacer and into the column. As seen best in FIGS. 4 and 5, the spacers are generally quarter-moon shaped in transverse cross section.

An assembly tool 60 may be used as shown in FIGS. 4 and 6 to properly align the treads with respect to each other and to the support column. The tool has a curved section 61 conforming to the cross-sectional shape and size of the column, and straight sections or legs 62 and 63 diverging at the same angle as the front and rear edges of the treads and adapted to lie against the front and rear edges of the treads when aligning a tread during assembly. The legs are joined to the curved section by shoulders 64 and 65 which lie against the ends of the tread when the tool and tread are properly engaged against the column. A pilot hole 66 is formed through the midportion of the curved section for aligning the tool with respect to the column, and thereby aligning a tread to the column. The tool is preferably made of steel or other suitable material, and has sufficient resiliency to enable it to be placed on and moved with respect to the column, while at the same time having sufficient rigidity to hold the tread aligned.

Figures 11, 12, 13, 14:
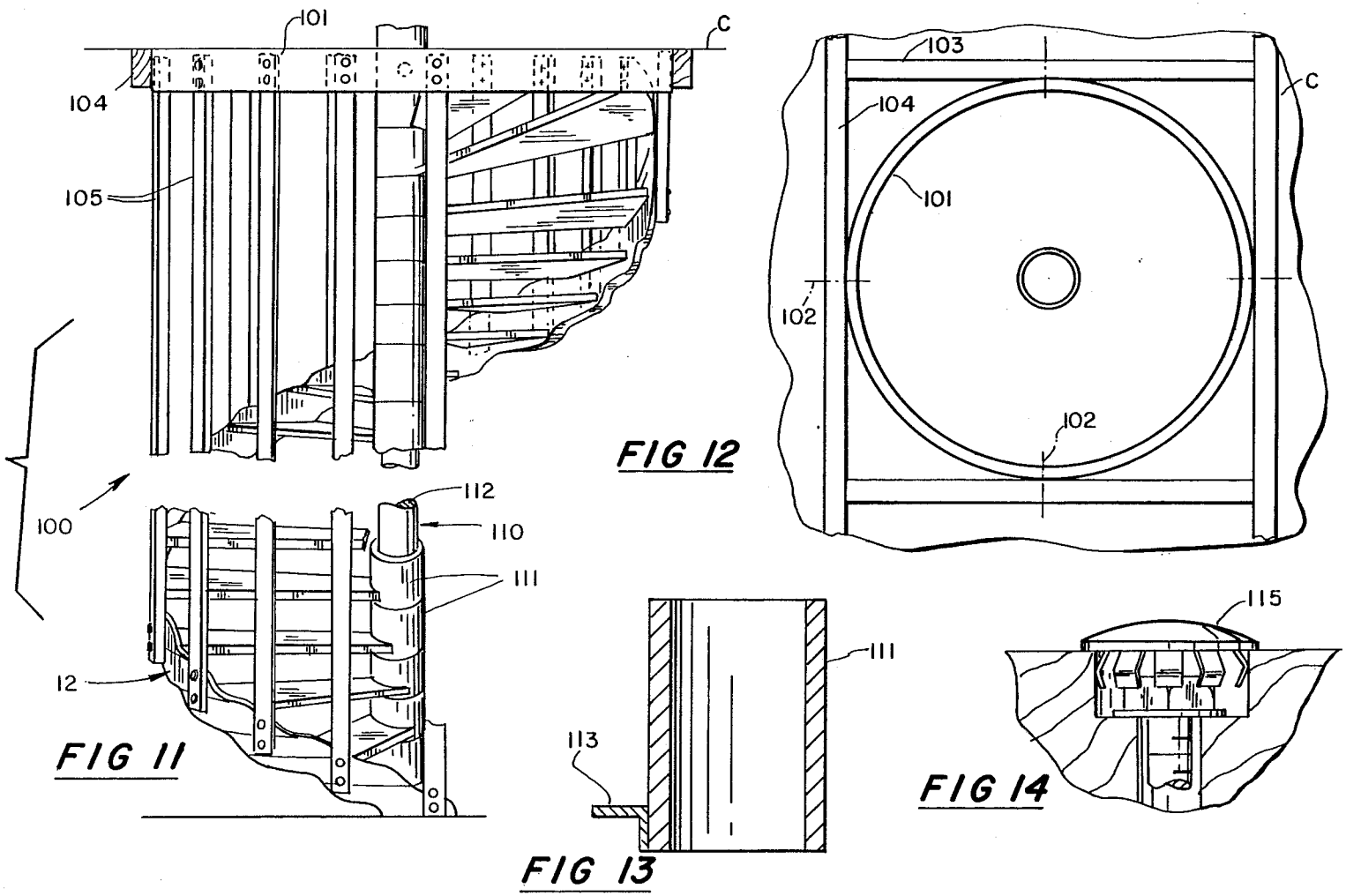
FIG. 11 is a view in elevation, with portions broken away, showing a further form of spiral or circular stair in which the balusters extend between a support ring at the top end of the stair and the stringer on which the treads are supported.
FIG. 12 is an enlarged, fragmentary somewhat schematic plan view of the stairway of FIG. 11, showing the manner in which the support ring may be attached to the framework of the floor at the top of the stair.
FIG. 13 a greatly enlarged, longitudinal sectional view of one of the riser sleeves used in the stair of FIG. 11.
FIG. 14 is a greatly enlarged, fragmentary sectional view of a decorative cap which may be used to cover the assembly holes used in constructing the stair of the invention.
Figure 15:
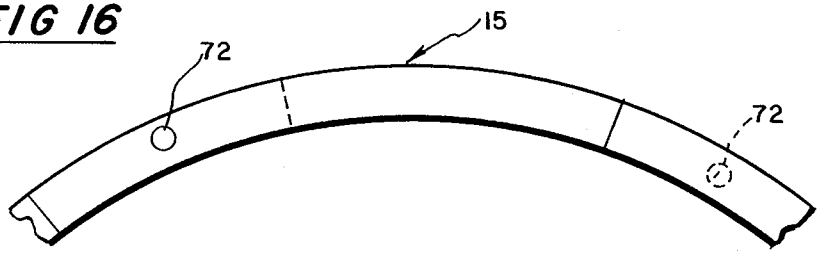
FIG. 15 is a fragmentary plan view of a portion of a hand rail according to the invention, in which the hand rail comprises individual components secured together.

As seen best in FIGS. 14 and 15, the hand rail 15 is also of modular construction, comprising a plurality of individual pieces 15A, 15B, etc. Opposite ends of each hand rail unit 15A, 15B, etc. are cut away on the top and bottom surfaces, respectively, at 70 and 71, whereby when two hand rail units are joined together in end-to-end relationship as shown in FIGS. 14 and 15, a lap joint is formed between the two pieces. The hand rail units may be pre-drilled as at 72, if desired, for receiving suitable fasteners, such as screws or the like 73 to secure the pieces together to form a unitary, continuous hand rail 15 as seen in FIG. 1. Glue may also be used in the hand rail joints, if desired.

Figure 7:
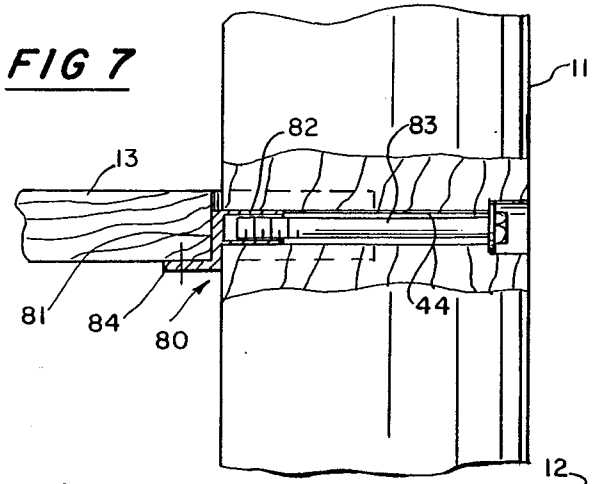
FIG. 7 is a slightly further enlarged, fragmentary, sectional view similar to FIG. 6, of a further form of the invention in which tread hangers are used to support the inner end of the treads to the support column.
Figure 8:
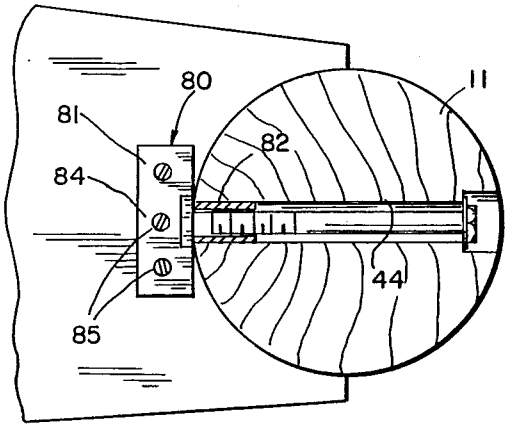
FIG. 8 is an enlarged, fragmentary, transverse sectional view similar to FIG. 5, showing the hanger attachment means of FIG. 7.

An alternate method of attaching the treads to the support column is shown in FIGS. 7 and 8. In this form of the invention, a tread hanger 80 is used to secure the inner end of the tread to the column. The hanger 80 comprises a metal bracket 81 which is L-shaped in transverse cross-section (a piece of angle iron, for example) and to which is attached an internally threaded sleeve 82. The sleeve is sized to fit snugly in the pre-drilled opening 44 in the column, with the bracket 81 held against the face of the column as shown in FIGS. 7 and 8, and a bolt 83 is extended through the opening 44 and into the sleeve to secure the bracket to the column. The inner end of the tread is then placed on the horizontal leg 84 of the bracket and secured thereto with suitable fasteners such as screws or the like 85.

Figure 10:
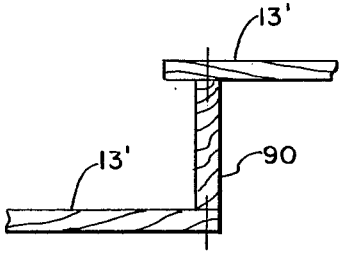
FIG. 10 is a sectional view taken along line 10—10 in FIG. 9.
Figure 9:
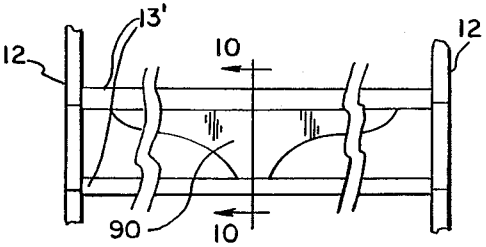
FIG. 9 is an enlarged fragmentary sectional view in elevation of a portion of a stair in which a tread support is provided between the ends of the treads to prevent sagging of the treads.

In some installations, the size of the stairway constructed may result in relatively long treads, such as shown at 13' in FIGS. 9 and 10. In such cases, it is possible that the treads could eventually begin to sag. In order to prevent this and yet still maintain the open look of the stairs, a center brace or support 90 is secured between adjacent treads.

A modified spiral or circular stair construction is indicated generally at 100 in FIGS. 11 and 12. In this form of the invention, a support ring 101 is secured in the ceiling "C" (floor of the upper level) by passing suitable fasteners 102 through the ring and into a frame 103, 104 provided for this purpose in the ceiling. Balusters 105 are secured at their uppers ends to the ring and at their lower ends to the stringer 12, thus at least partially supporting the stair 100 from the support ring. The balusters 105 also serve as a hand rail, although a separate hand rail (not shown) could be attached to the inside surfaces of the balusters if desired.

Further, as seen in FIG. 11, the center support column 110 in this form of the invention comprises a plurality of separate riser sleeves 111 telescopically received over a continuous stem 112. A hanger bracket 113 similar to that previously described is suitably affixed to the sleeve, as by welding or the like, near the lower end thereof for supporting the inner ends of the treads. In assembling this form of the invention, the riser sleeves 111 are placed over the stem 112 in stacked relationship as shown in FIG. 11, and rotated to the proper position to secure successive treads thereto. This form of support column could also be used in the previously described forms of the invention, if desired.

The stringer 12 and treads 13 in this form of the invention are constructed essentially the same as those described in connection with the forms of the invention shown in FIGS. 1 through 10.

FIG. 14 shows one type of cap 115 which may be used to close the holes in the various components of the stair of the invention through which the fasteners are passed. This cap 115 may be made of brass, for example, for decorative purposes. Obviously, other materials and designs for the cap or closure could be used. For example, the closure could simply comprise a wooden plug, or could be made of plastic or the like.

Figure 17:
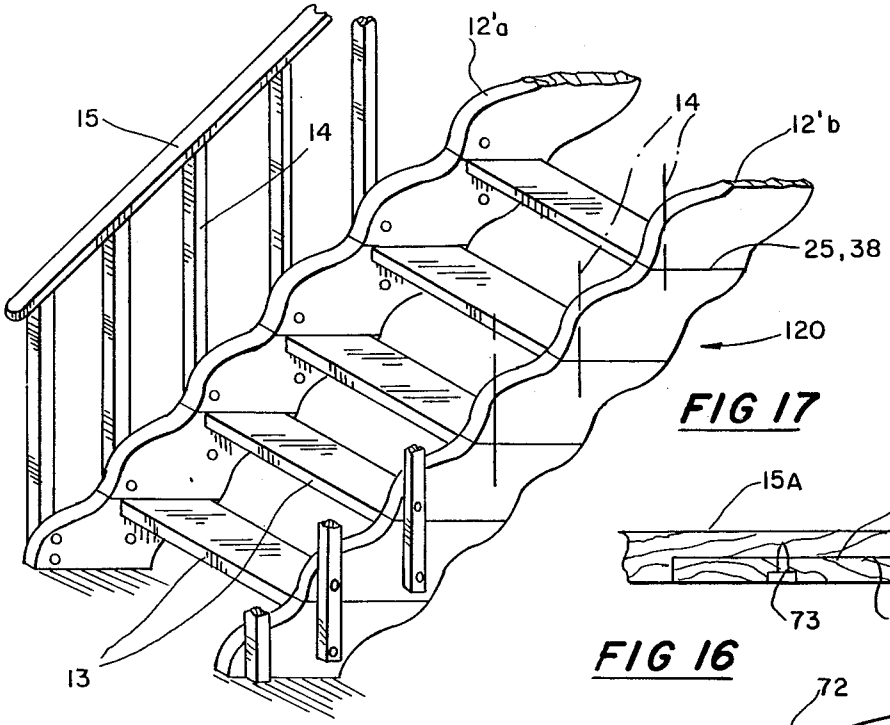
FIG. 17 is a fragmentary perspective view of a further form of stair constructed in accordance with the invention, with portions removed for purposes of clarity and in which the stair is of straight design.
Figure 16:
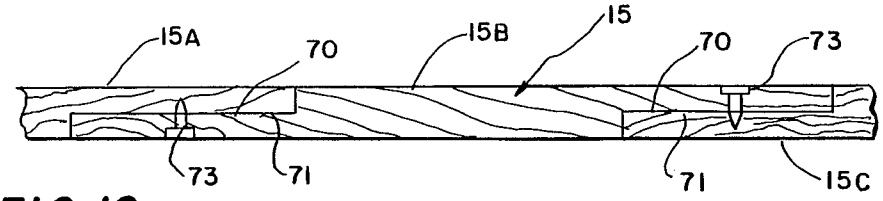
FIG. 16 is a fragmentary view in elevation, with parts in section, of the hand rail of FIG. 15.

In FIG. 17 a stair of straight design is indicated generally at 120. This stair comprises a pair of stringers 12'a and 12'b extending parallel to one another at an upwardly inclined angle. The stringers in this form of the invention are assembled in situ from a plurality of premanufactured units 12'A, 12'B, etc., just as in the previously described forms of the invention. Treads 13 are supported on the stringers in spanning relationship thereto by means of a mortise and tenon joint 25, 38 as previously described. It should also be noted that the balusters 44 which support the hand rails 15 span the mortise joints as in the previous forms of the invention.

Proper design of the riser units used in a predetermined stair construction enables a combination of circular and straight stair sections for a desired finished concept. Moreover, the exercise of proper quality control in the manufacture of stair components eliminates the need for preassembly as is required in conventional stair constructions. Further, the present invention makes it possible to mass produce stair components at a cost much less than that required for conventional stair constructions.

Although the invention has been described with reference to a particular embodiment, it is to be understood that this embodiment is merely illustrative of the application of the principles of the invention. Numerous modifications may be made therein and other arrangements may be devised without departing from the spirit and scope of the invention.

I claim:

1. In a stair construction having at least one stringer, a plurality of treads supported on the stringer, and a hard rail, the improvement comprising:

a plurality of individual stringer units having top and bottom ends and front and back edges, said stringer units secured together in situ in end-to-end relationship with one another to form a continuous stringer assembly extending from the bottom to the top of the stair construction said front and back edges have a curved configuration, with a portion near each of the top and bottom ends extending generally vertically and a portion between the ends extending generally horizontally, one end of each stringer unit having tread supporting means for engaging and supporting one end of a respective tread, the other end of each stringer unit being capable of being trimmed away to shorten the vertical height of the stringer unit and thus to shorten the height of the stair construction, and at least said other end of each stringer unit being shaped at the front and back edges thereof so as to have vertically extending portions whereby said other end of the stringer unit can be trimmed without altering the continuity of the shape of the assembled stringer units.

2. A stair construction as claimed in claim 1, wherein:

the tread supporting means comprises a notch or mortise formed in the stringer unit; and a tenon formed on said one end of the tread, said tenon being received in said mortise and secured to said stringer unit.

3. A stair construction as claimed in claim 2, wherein:

a plurality of balusters are secured to the stringer, at least one baluster being secured to each pair of secured-together stringer units in spanning relationship to the joint formed between said secured-together stringer units, and including fastening means extended into the baluster and into each of the secured-together stringer units on opposite sides of the joint.

4. A stair construction as claimed in claim 2, wherein:

the tenon has a narrower width than the mortise to permit relative expansion and contraction between the stringer and the tread.

5. A stair construction as claimed in claim 1, wherein:

the hand rail comprises a plurality of individual pieces secured together in situ.

6. A stair construction as claimed in claim 1, wherein:

said front and back edges have a curved configuration, with a portion near each of the top and bottom ends extending generally vertically and a portion between the ends extending generally horizontally;

the tread supporting means comprises a notch or mortise formed in the stringer unit, and a tenon formed on said one end of the tread, said tenon being received in said mortise and secured to said stringer unit, the tenon having a narrower width than the mortise to permit relative expansion and contraction between the stringer and the tread;

a plurality of balusters are secured to stringer, at least one baluster being secured to each pair of secured-together stringer units in spanning relationship to the joint formed between said secured-together stringer units, and including fastening means extended into the baluster and into each of the secured-together stringer units on opposite sides of the joint; and the hand rail comprises a plurality of individual pieces secured together in situ to form a one-piece, continuous hand rail.

7. A stair construction as claimed in claim 1, wherein:

the stair comprises a spiral or circular stair, and includes a center support column;

means on said support column for supporting the other end of the treads;

the tread comprising means on the stringer comprises a notch or mortise formed in the stringer unit, and a tenon formed on said one end of the tread, said tenon being received in said mortise and secured to said stringer unit; and each stringer unit has a curvature whereby when all the stringer units are secured together a spiral-shaped stringer is formed, said treads being supported at one end on the stringer and the other end on the column.

8. A stair construction as claimed in claim 7, wherein:

spacers are secured to said column between the treads to space the treads along the column and assist in supporting said other ends of the treads.

9. A stair construction as claimed in claim 7, wherein:

a hanger bracket is secured to said column for supporting each tread on the column, said hanger bracket having an internally threaded sleeve received in a bore extending transversely through the column, and a threaded fastener extended through the bore and into said sleeve to secure the hanger bracket to the column.

10. A stair construction as claimed in claim 7, wherein:

the center support column comprises a plurality of individual riser sleeves telescoped over a continuous stem, there being one riser sleeve for each tread, and the riser sleeves being progressively rotated on the stem to position successive treads.

11. A stair construction as claimed in claim 7, wherein:

a brace is secured between superadjacent treads for supporting the treads between their ends and prevent sagging thereof.

12. A stair construction as claimed in claim 1, wherein:

the stair comprises a straight inclined stairway including a pair of parallel, spaced apart stringers with the treads supported therebetween.

* * * * *